United States Patent [19]

Zmarlicki

[11] Patent Number: 4,973,167

[45] Date of Patent: Nov. 27, 1990

[54] CONTINUOUS CONCRETE MIXING APPARATUS

[76] Inventor: Hieronim Zmarlicki, Deborah La., Farmington, Conn. 06032

[21] Appl. No.: 225,935

[22] Filed: Jul. 29, 1988

[51] Int. Cl.[5] ..... B28C 5/20

[52] U.S. Cl. ..... 366/57; 34/135; 366/228

[58] Field of Search ..... 366/44, 27, 28, 56, 366/57–59, 135, 187, 225, 228, 227, 229, 230, 233; 69/30; 34/135, 136; 432/118

[56] References Cited

U.S. PATENT DOCUMENTS

| | | | |
|---|---|---|---|
| Re. 23,320 | 1/1951 | Willard et al. | 366/44 |
| 928,850 | 7/1909 | Cumiskey | 366/57 |
| 1,093,723 | 4/1914 | Owens | 366/57 |
| 1,723,367 | 8/1929 | Paris | 366/57 |
| 1,901,305 | 3/1933 | Knowles | 366/57 |
| 4,403,865 | 9/1983 | Fejmart | 366/228 |

*Primary Examiner*—Timothy F. Simone
*Attorney, Agent, or Firm*—Robert S. Smith

[57] ABSTRACT

Apparatus for mixing cement, aggregate and water to form concrete includes a drum having an axis, an interior face and an exterior face; apparatus for rotating the drum; and a plurality of vanes for directing the associated cement, aggregate and water to provide thorough mixing, the vanes being disposed in a plurality of columns extending generally parallel to the axis of the drum, at least some of the vanes being disposed to direct flow of the associated cement, aggregate and water in first direction and at least some other of the vanes being directed to direct flow of the associated cement, aggregate and water in a second direction which is opposite to the first direction. The drum has first and second open ends and the ends are each substantially in the form of a truncated cone. The axis of the apparatus is substantially horizontal throughout all operations of the apparatus.

20 Claims, 8 Drawing Sheets

CONTINUOUS CONCRETE MIXING APPARATUS

BACKGROUND OF THE INVENTION

The invention relates to concrete mixing apparatus and more particularly to concrete mixing apparatus intended to be either positioned at the work or job site or placed on a truck such as a flat bed truck. The prior art includes transit concrete mixing trucks which include a very heavy, complex and expensive drive mechanism. These mechanisms typically provide a drum which is mounted on a central shaft which is driven with a motor and transmission. The mechanism is particularly complex and heavy because of a need to rotate the drum when the axis of the drum is in at least two different positions. The two different positions being the loading and unloading positions of the drum. It will be understood that the term concrete mixing apparatus as used herein refers to apparatus for mixing cement, water, and an aggregate such as sand and/or stone. One problem that is encountered with conventional transit concrete mixers is that the batches of concrete that are mixed with such apparatus are ordinarily quite large and thus there may be waste due to the concrete starting to set up or cured before it can be used. This can in turn cause problems with cleaning of the mixing apparatus, waste of raw materials, and environmental problems due to dumping of the wasted concrete.

It is an object of the invention to provide apparatus which is more simple and much lighter in weight than the prior art apparatus.

It is another object of the invention to provide apparatus which is easily transported such as by a flatbed truck or trailer.

It is still another object of the invention to provide apparatus which minimizes cleaning problems.

Yet another object of the invention is to provide apparatus which provides a continuous output of freshly made concrete and thus avoids problems with concrete that has started to set up or cure before it can be used.

SUMMARY OF THE INVENTION

It has now been found that these and other objects of the invention may be attained in an apparatus for mixing cement, aggregate and water to form concrete which includes a drum having an axis, an interior face and an exterior face. The apparatus also includes means for rotating the drum and a plurality of vanes for directing the associated cement, aggregate and water to provide thorough mixing. The vanes are disposed in a plurality of columns extending generally parallel to the axis of the drum, at least some of the vanes are disposed to direct flow of the associated cement, aggregate and water in a first direction and at least some other of the vanes are directed to direct flow of the associated cement, aggregate and water in a second direction which is opposite to the first direction. In some forms of the invention the drum has first and second open ends and the drum has ends thereof which are each substantially in the form of a truncated cone. The axis of the apparatus may be substantially horizontal and the the axis may remain horizontal throughout all operations of the apparatus. The drum may be substantially rotationally symmetrical and the means for rotating may include a drive mechanism engaging the exterior face of the drum. Some of the vanes may be disposed at a 45 degree angle with respect to the axis of the drum and some of the vanes may be disposed at an angle substantially 135 degrees with respect to the axis of the drum.

BRIEF DESCRIPTION OF THE DRAWING

The invention will be better understood by reference to the accompanying drawing in which.

DESCRIPTION OF THE PREFERRED EMBODIMENT

Figure 1:
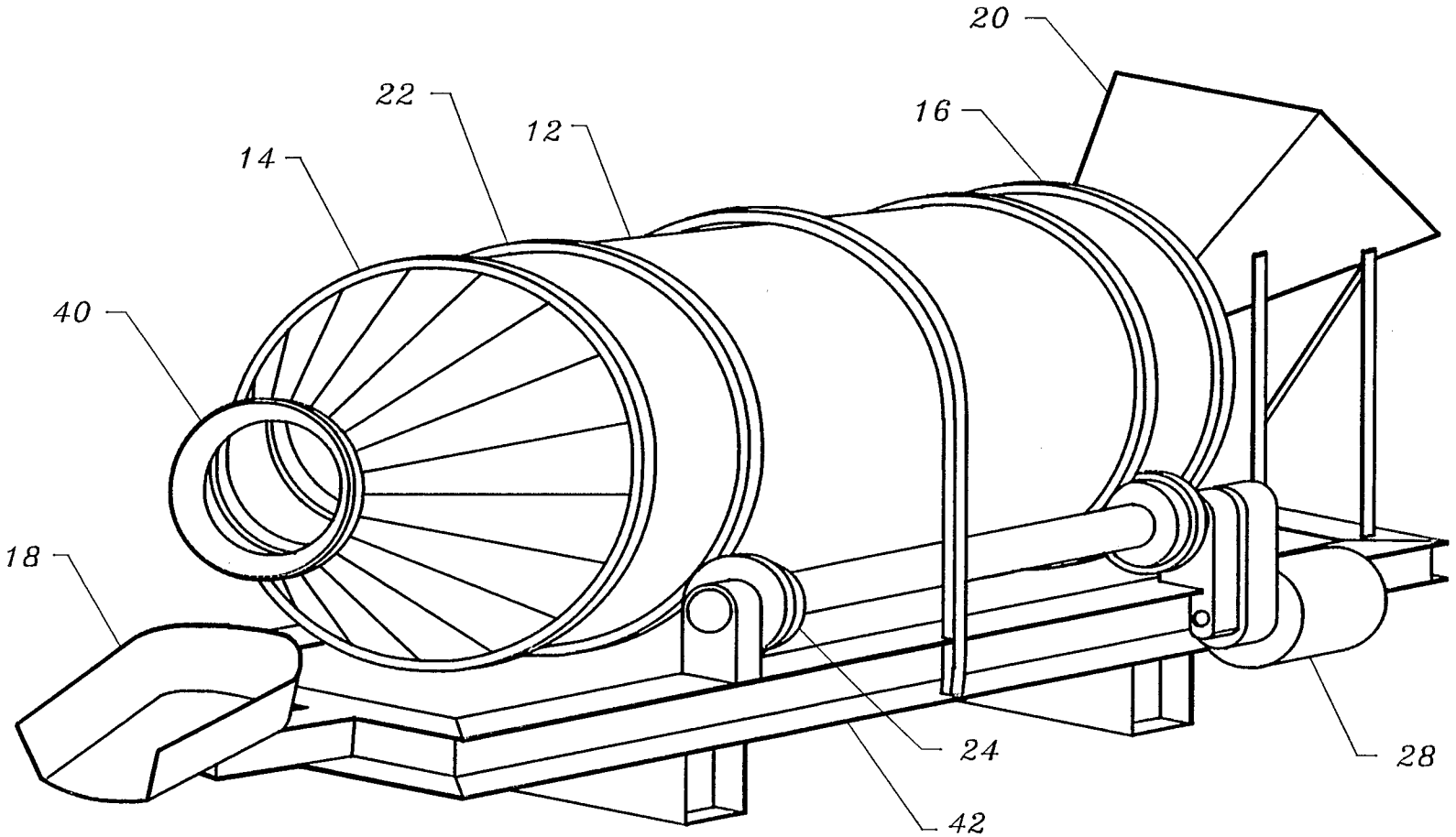
FIG. 1 is a perspective view of the entire concrete mixing apparatus in accordance with one form of the present invention.
Figure 3:
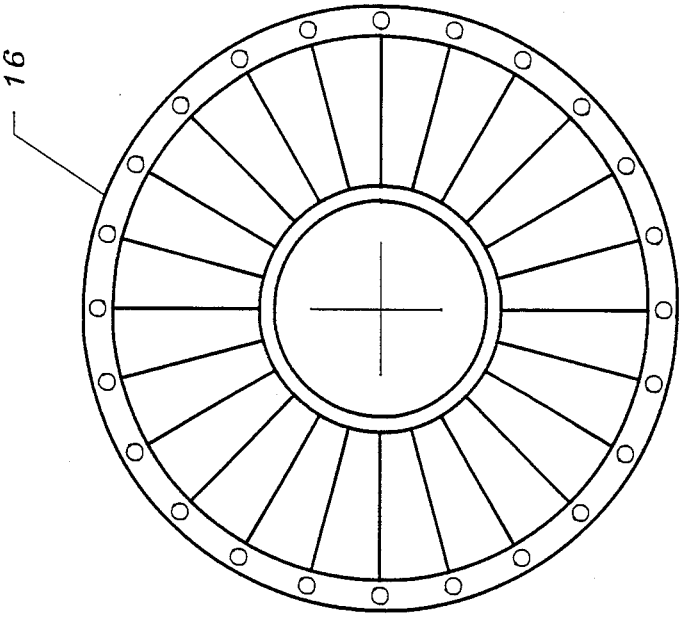
FIG. 3 is a diagramatic front elevational view of the inlet mixer head.
Figure 2:
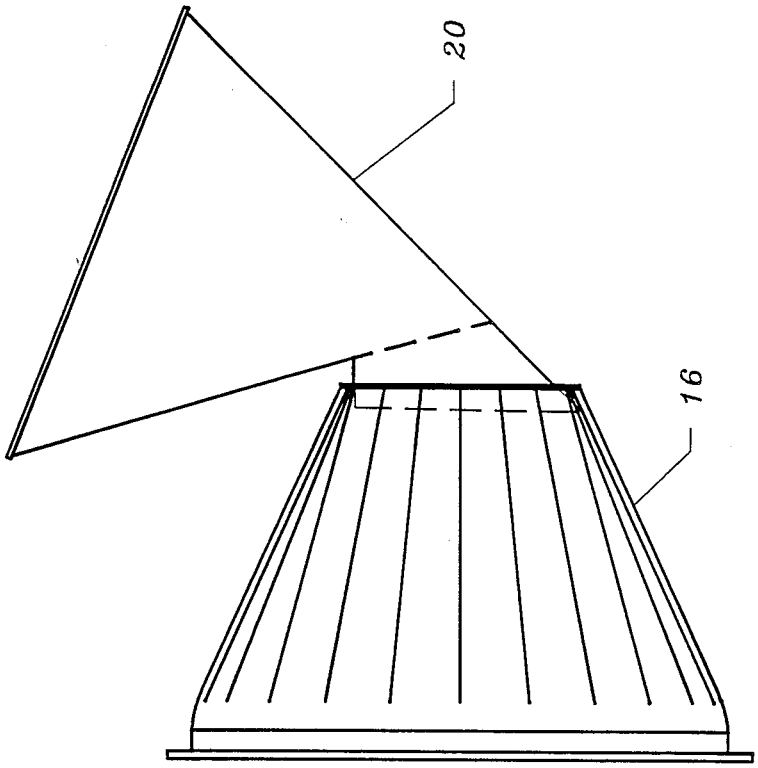
FIG. 2 is a diagramatic side elevational view of the inlet mixer head and feeding funnel shown in FIG. 1.

Referring now to FIGS. 1–9 there is shown the apparatus 10 in accordance with one form of the invention which includes a central cylindrical drum 12 to which is attached a truncated conical outlet mixer head 14 and a truncated conical inlet mixer head 16. The inlet mixer head 16 includes a blade (not shown) that is obliquely disposed with respect to the interior wall of the inlet mixer head 16 to insure that the water and cement and aggregate move away from the wall thereof and thus move into the generally cylindrical drum 12. Cooperating with the outlet mixer head 14 is chute 18. Cooperating with the inlet mixer head 16 is a feeding funnel 20.

Figure 5B:
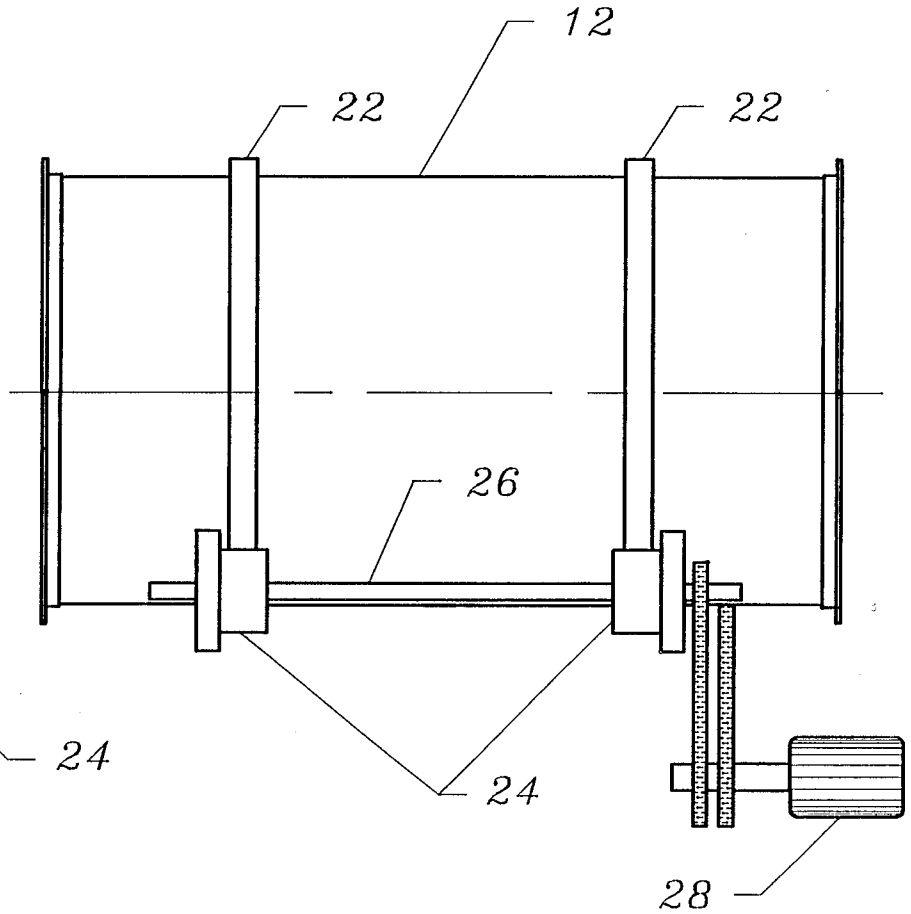
FIGS. 5*a* and 5*b* are diagramatic views illustrating the drive mechanism for one form of the apparatus in accordance with the invention.
Figure 5A:
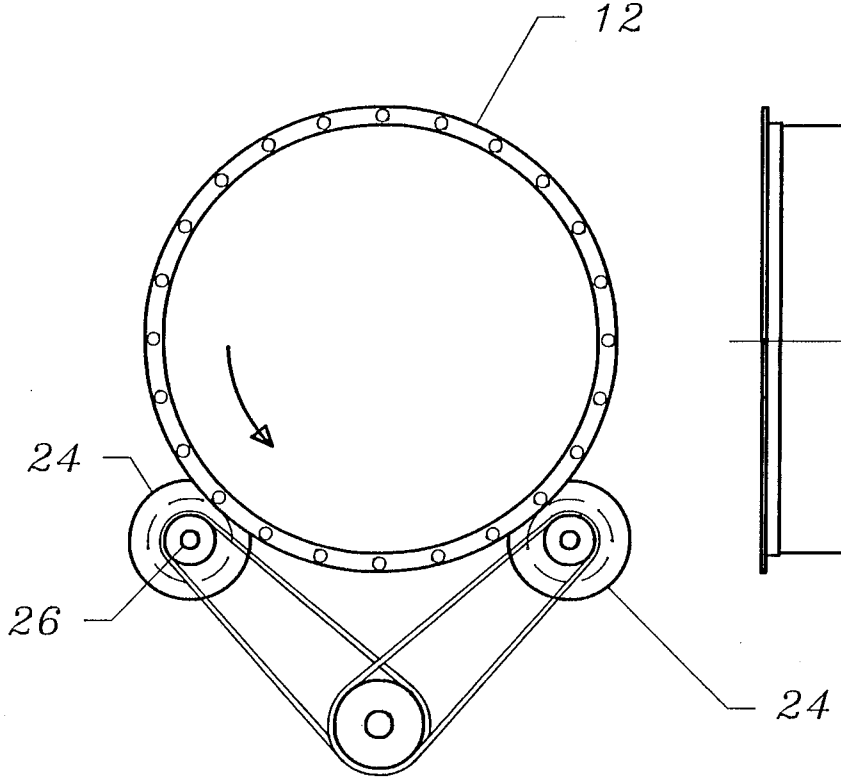

As best seen in FIGS. 1, 5*a* and 5*b*, the central cylindrical drum 12 has two ring shaped bearing surfaces 22, 22 extending circumferentially which are carried on rollers 24, 24, 24, 24. As will be apparent from the drawing, two rollers 24, 24 are mounted on a single shaft 26. As best seen in FIG. 5*a*, there are two such assemblies and they support the central cylindrical drum 12 by contacting the bearing surfaces and cause that central cylindrical drum 12 to rotate. More particularly the rollers 24, 24 are each fixed to one of the shafts 26, 26 and each shaft 26 is driven by a chain 27 and an electric motor 28. In the preferred embodiment only a five horse power electric motor 28 is required.

Figure 4:
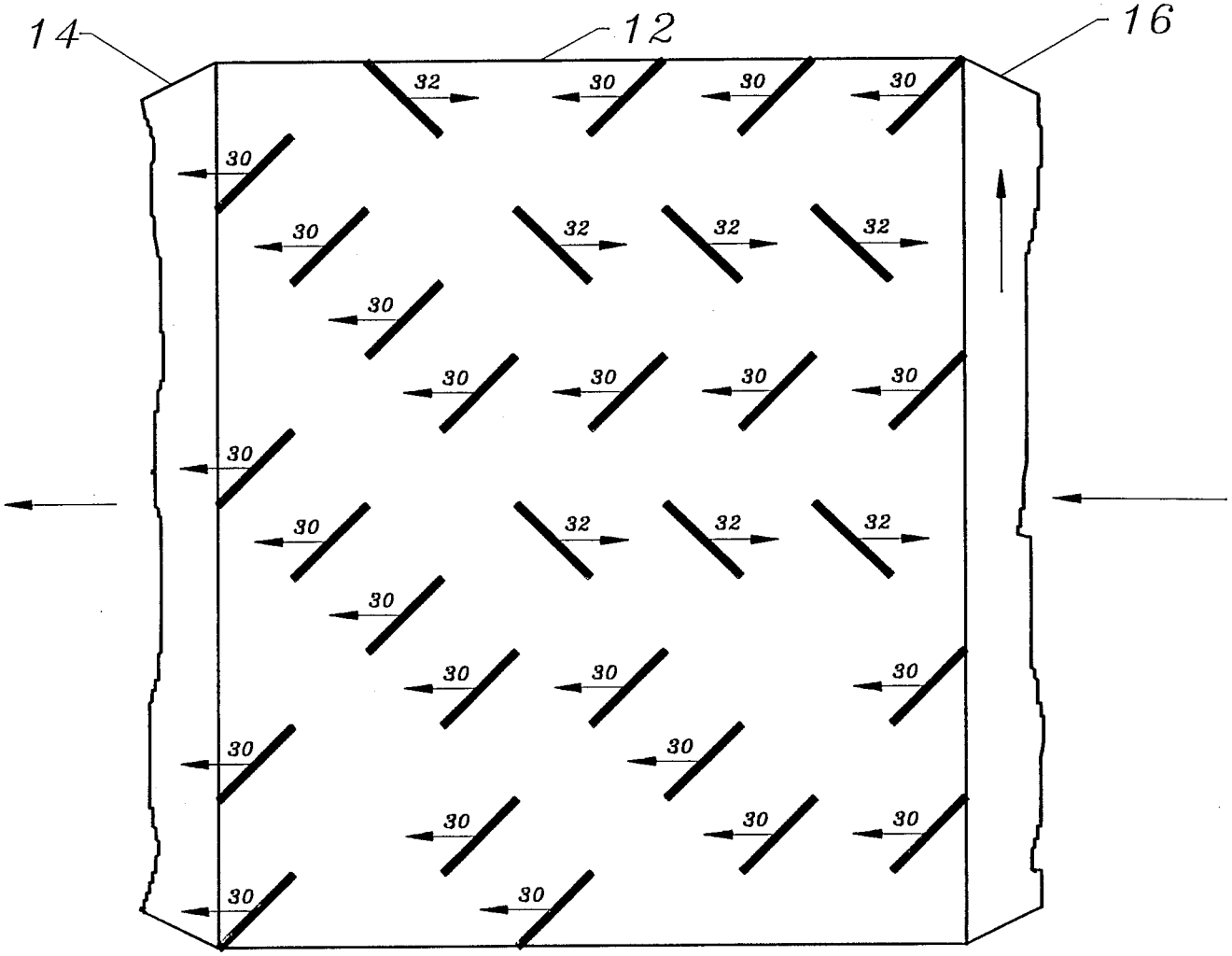
FIG. 4 is a developed diagramatic view of the arrangement of vanes in the cylindrical mid section of the apparatus in accordance with one form of the invention.

Referring now particularly to FIG. 4, there is shown a developed view of the arrangement of vanes as will be seen from the schematic the direction of flow of material through the central cylindrical drum 12 is generally, as viewed in FIG. 4, from the lower most portion to the upper most portion. It will be understood that it is essential ordinarily to have more vanes directing flow of the ingredients from the inlet to the outlet than direct in the opposite direction. The vanes which urged the flow in the direction of final flow are indicated by the numeral 30. A number of additional vanes indicated by the number 32 direct flow in the opposite direction. At least some of the vanes are disposed in columns directing flow towards the inlet mixer head 16 and others are disposed to direct flow toward the outlet mixer head 14.

Figure 6:
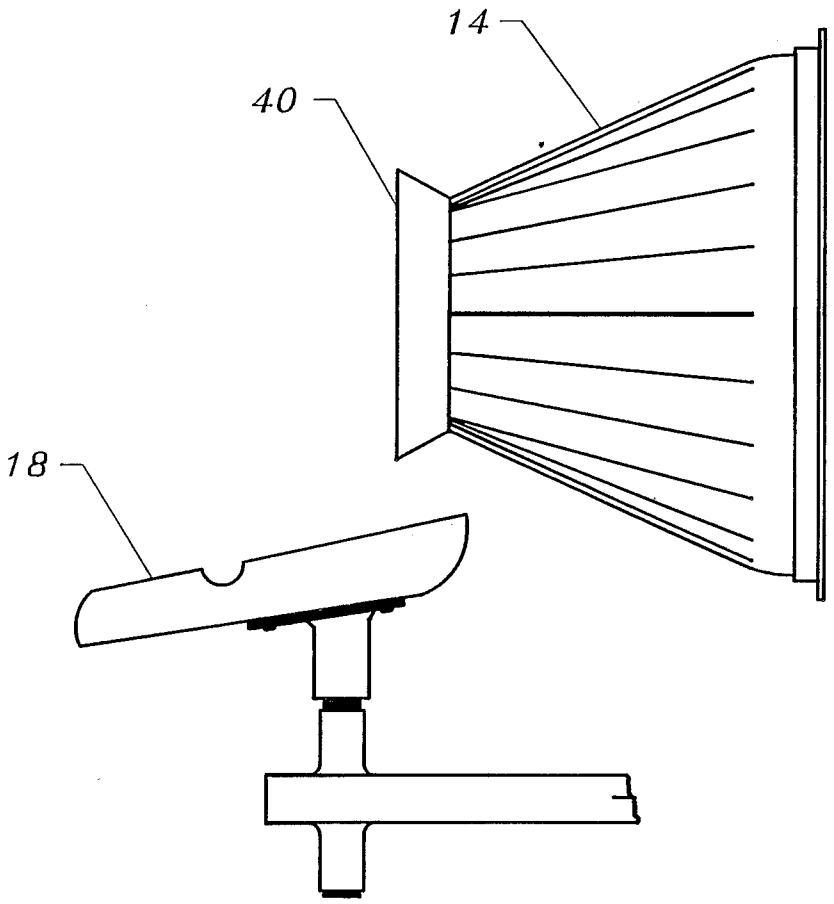
FIG. 6 is a diagramatic view illustrating in greater detail the outlet mixer head and outlet chute illustrated in FIG. 1.
Figure 7:
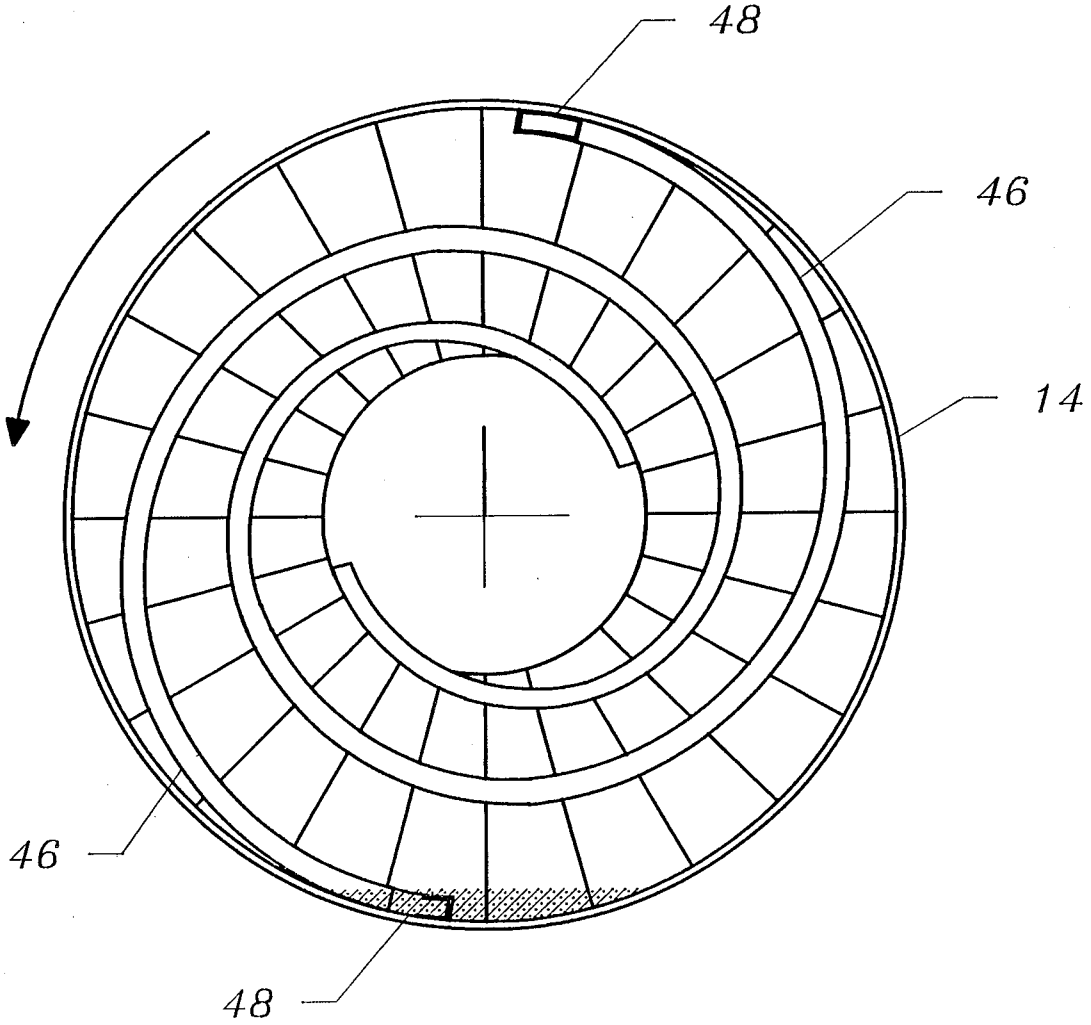
FIG. 7 is a diagramatic view illustrating the interior construction and operation of the outlet mixer head as concrete is initially moved out of the apparatus.
Figure 8:
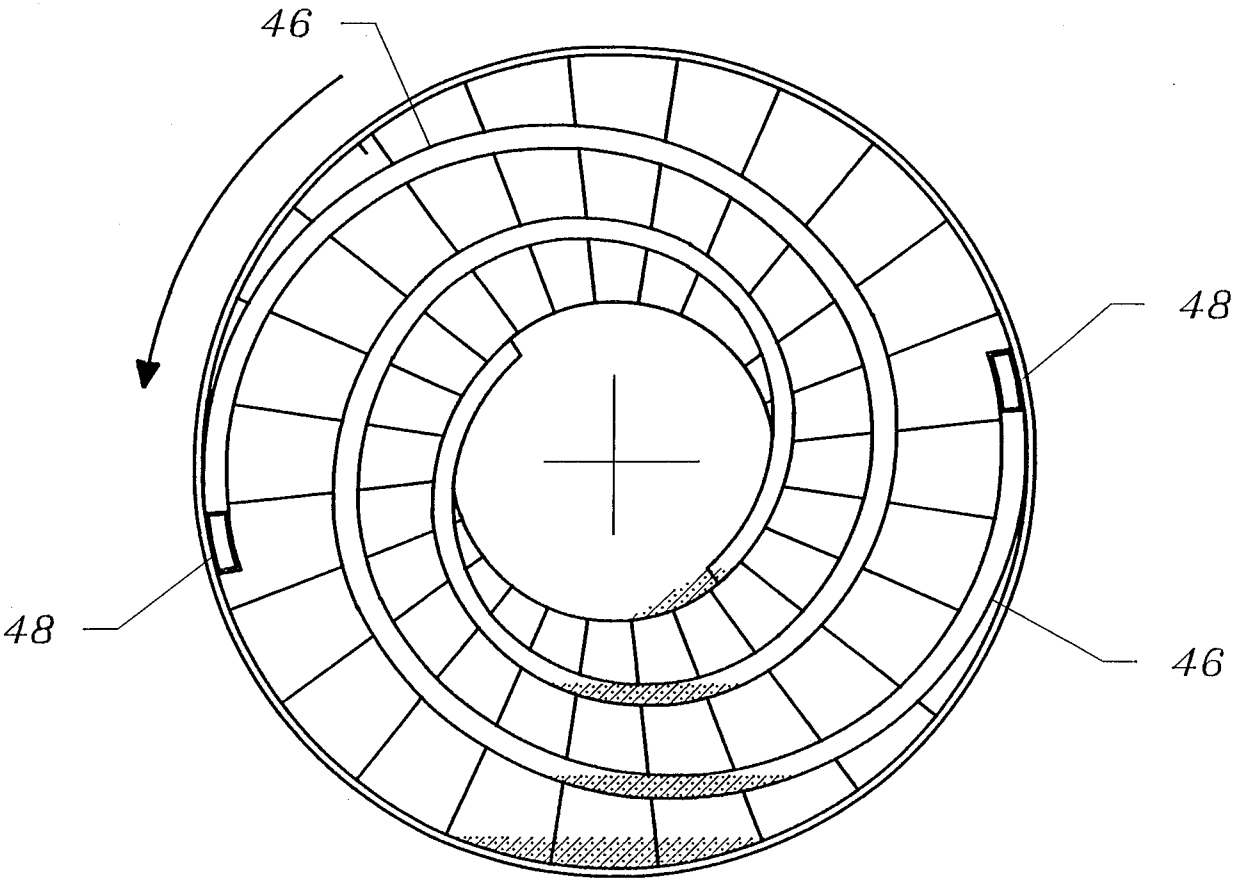
FIG. 8 is a view similar to FIG. 7 illustrating the operation of the outlet mixer head after still further operation.

Referring now to FIGS. 6, 7 and 8 there is shown the outlet mixer head 14 and outlet chute 18 in greater detail. The outlet mixer head 14 includes a flange 40 for directing the flow into the outlet chute 18 which is supported on the frame of the apparatus 10. This frame shown in FIG. 1 includes a plurality of I-shaped beams 42.

Figure 9:
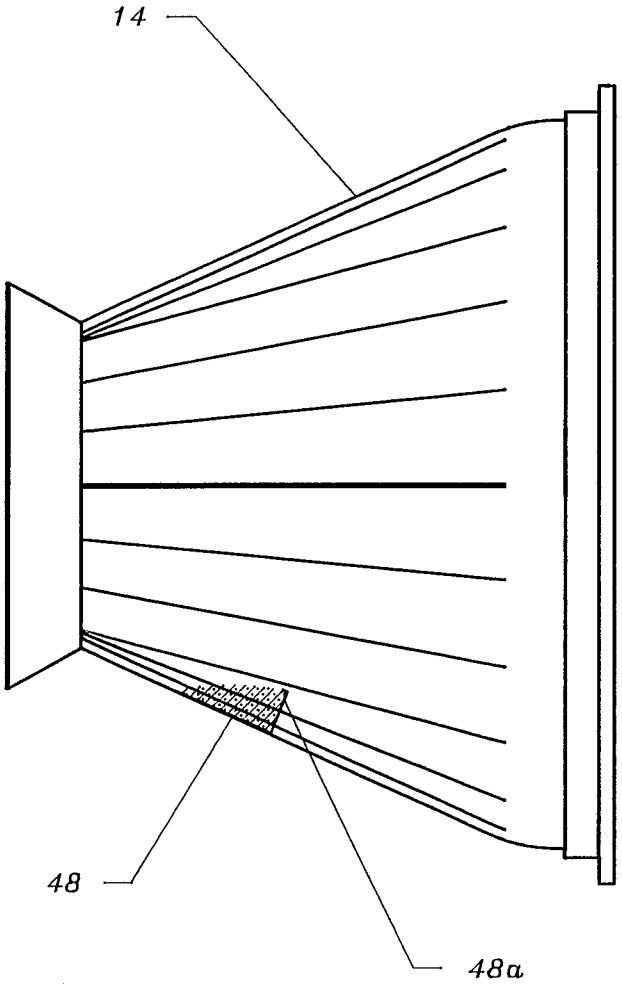
FIG. 9 is a partially broken away diagramatic view of the outlet mixer head which illustrates the cross section of the spiral member in the interior in greater detail.

The construction of the inner face of the outlet mixer head 14 includes two unloaders which each comprise a spiral shaped member 46 which has a scoop or bail 48 at the beginning thereof. The scoop 48 is disposed at the end of the spiral shaped member 46 and more particularly at the end thereof nearest the central cylindrical drum 12. As best seen in FIG. 9 the cross section of the spiral shaped member 46 is typically such that it extends substantially at right angles to the wall of the outlet mixer head 14 and is further provided with a lip 48*a* to retain the mixed concrete or water as it is ejected from the apparatus 10.

In operation, water, cement and an aggregate such as sand or stones are fed into the inlet mixer head 16 by means of the feed funnel 20. This may be accomplished manually, although ideally, it is accomplished by use of an automatic batching apparatus (not shown) which automatically feeds the required proportions and quantities of raw materials required to continuously produce the desired output of concrete. The vanes 30, 32 cause an ebb and flow in effect in the material such that the raw materials are alternately pushed toward the outlet mixer head 14 and pulled toward the inlet mixer head 16. If only a single batch of raw material is inserted into the apparatus 10, a typical cycle of operation takes about three minutes. In this three minutes the central cylindrical drum 12 will turn at the rate of six turns per minute or about 18 times.

It will be understood that ordinarily the apparatus 10 will be operated in a continuous manner such that additional materials are continually added to the apparatus 10 while it is operating. Thus, the practical limitation on the capacity of the machine is determined by the height of the vanes 30, 32 in the central cylindrical drum 12. Ordinarily, it will be desired not to have the mixing material rise to a higher level than the height of the individual vanes 30, 32.

During a one hour operating period, the central cylindrical drum 12 will make 360 revolutions (60 minutes × 6 turns/minute). The two unloaders, each comprising a spiral shaped member 46 and a scoop or bail 48 are mounted at the outlet mixer head 14 are helically contoured and direct the outlet of the mixed concrete. Each such scoop or bail 48 is able to bail out 0.22 cubic feet per revolution. Because there are two such scoops 48 the apparatus 10 is capable of delivering 0.44 cubic feet per revolution. Thus, the apparatus 10 in the preferred embodiment will mix and direct concrete out the outlet mixer head 14 at the rate of 158.4 cubic feet or 5.9 cubic yards per hour. The spiral shaped members each have a height from the supporting wall, in the preferred embodiment, of 4.5 inches and a one inch lip. The number of coils is 1 and ⅛ and the total length of each spiral shaped member 46 is 66 inches in the preferred embodiment. The central cylindrical drum 12 has a length of 7 feet and an outer diameter of approximately 36 inches in the preferred embodiment. In the preferred embodiment there are 30 vanes which are each identified by the numeral 30 or 32. The vanes 30, 32 are equally spaced in 6 rows with 5 blades in each row. Ordinarily the vanes 30 are mounted at either a 45 degree or 135 degree angle with respect to the axis of the central cylindrical drum 12. Each vane or blade in the preferred embodiment has dimensions of 12 inches by 3.5 inches with the longer side being disposed adjacent to the interior walls central cylindrical drum 12. The total surface of the blades is 8.7 square feet in the preferred embodiment. The effect of the mixing operation is to cause the ingredients to pass along a path which is 360 yards long because of the alternating arrangement of the vanes 30, 32.

The ring shaped bearing surfaces 22, 22 are 1½ by 1½ inches in the preferred embodiment. The outlet mixer head 14 and the inlet mixer head 16 are joined to the central cylindrical drum 12 by flanges which are secured together by 24 equally spaced bolts.

The apparatus 10 may use gears instead of rollers to drive the central cylindrical drum 12 in other forms of the invention. It will be seen that the apparatus in accordance with the invention will automatically eject concrete that is thoroughly mixed and in addition will automatically eject even water that is run into the central cylindrical drum 12. More specifically, the apparatus 10 will eject substantially all concrete or water that is placed within the apparatus.

The invention has been described in terms of an illustrated preferred embodiment. Persons skilled in the art may upon exposure to the teachings herein conceive other variations in structure or other applications for the invention. Such variations are deemed to be encompassed by the by the disclosure, the invention being limited only by the appended claims.

Having thus described my invention I claim:

1. Apparatus for mixing cement, aggregate and water to form concrete which comprises:

a drum having an axis; an open first axial extremity for loading of cement, aggregate and water and an open second axial extremity for unloading cement, aggregate and water; an interior face and an exterior face, said axis being generally horizontal during loading, mixing and unloading of said apparatus;

means for rotating said drum in a single direction of rotation throughout all operations including loading, mixing and unloading;

means for directing cement, aggregate and water from said first axial extremity to said second axial extremity comprising a plurality of vanes, at least some of said vanes being disposed to direct flow of the associated cement, aggregate and water in a first direction toward said first axial extremity and at least some other of said vanes being disposed to direct flow of associated cement, aggregate and water in a second direction toward said open second axial extremity, said vanes collectively moving the cement, aggregate and water ultimately toward said second axial extremity.

2. The apparatus as described in claim 1 wherein:

said vanes are disposed in a plurality of columns extending generally parallel to the axis of said drum.

3. The apparatus as described in claim 2 wherein:

more vanes are directing the flow of cement, concrete and aggregate toward said open second axial extremity than toward said open first axial extremity.

4. The apparatus as described in claim 3 wherein:

said drum has ends thereof which are each substantially in the form of a truncated cone.

5. The apparatus as described in claim 4 wherein:

each of said ends has an interior surface and an exterior surface, said end of said drum at said second axial extremity including at least one spiral shaped unloader on said interior surface thereof.

6. The apparatus as described in claim 5 further including:

a first bail is disposed at one end of said one spiral shaped unloader.

7. The apparatus as described in claim 6 further including:

a second spiral shaped unloader disposed on the interior surface of said end of said drum at said second axial extremity and a second bail is disposed at one axial extremity of said second spiral shaped unloader.

8. The apparatus as described in claim 7 wherein:

said drum is substantially rotationally symmetrical.

9. The apparatus as described in claim 8 wherein:

said means for rotating includes a drive mechanism only frictionally engaging the exterior face of said drum.

10. The apparatus as described in claim 9 wherein:

some of said vanes are disposed at a 45 degree angle with respect to the axis of said drum and some of said vanes are disposed at an angle of substantially 135 degrees with respect to the axis of said drum.

11. The apparatus as described in claim 10 wherein:

said first and second spiral shaped blades are coaxial.

12. The apparatus as described in claim 11 wherein:

each of said spiral shaped blades is disposed substantially at right angles to said one end of said drum.

13. The apparatus as described in claim 12 wherein:

all of said vanes are substantially the same size and shape.

14. The apparatus as described in claim 13 wherein:

at least four vanes are disposed in each column.

15. Apparatus for mixing cement, aggregate and water to form concrete which comprises:

a drum having an axis, an open first axial extremity for loading of cement, aggregate and water and an open second axial extremity for unloading cement, aggregate and water; an interior face and an exterior face, said axis being generally horizontal during loading, mixing and unloading of said apparatus;

means for rotating said drum in a single direction of rotation throughout all operations including loading, mixing and unloading; means for directing cement, aggregate and water out of said drum comprising (a) a plurality of vanes for directing the associated cement, aggregate and water to provide thorough mixing, at least some of said vanes being disposed to direct flow of the associated cement, aggregate and water in a first direction toward said first axial extremity and at least some other of said vanes being disposed to direct flow of associated cement, aggregate and water in a second direction toward said open second axial extremity, said vanes collectively moving the cement, aggregate and water ultimately toward said second axial extremity and (b) said second axial extremity of said drum has an end thereof, which is substantially in the form of a truncated cone, having at least one spiral shaped unloader disposed within the interior thereof.

16. The apparatus as described in claim 15 further including:

a first bail is disposed at one end of said one spiral shaped unloader.

17. The apparatus as described in claim 16 further including:

a second spiral shaped unloader disposed on the interior surface of said end of said drum at said second axial extremity and a second bail disposed at one axial extremity of said second spiral shaped unloader.

18. The apparatus as described in claim 17 wherein:

some of said vanes are disposed at a 45 degree angle with respect to the axis of said drum and some of said vanes are disposed at an angle of substantially 135 degrees with respect to the axis of said drum.

19. The apparatus as described in claim 18 wherein:

all of said vanes are substantially the same size and shape.

20. The apparatus as described in claim 19 wherein:

at least four vanes are disposed in each column.

* * * * *